US007428794B2

(12) United States Patent
Oz

(10) Patent No.: US 7,428,794 B2
(45) Date of Patent: Sep. 30, 2008

(54) TELESCOPING STOCK

(76) Inventor: Moshe Oz, 30/4 Nordau Blvd., 63113 Tel-Aviv (IL)

( * ) Notice: Subject to any disclaimer, the term of this patent is extended or adjusted under 35 U.S.C. 154(b) by 59 days.

(21) Appl. No.: 11/493,402

(22) Filed: Jul. 26, 2006

(65) Prior Publication Data

US 2007/0056202 A1 Mar. 15, 2007

Related U.S. Application Data

(60) Provisional application No. 60/702,472, filed on Jul. 26, 2005.

(51) Int. Cl.
*F41C 23/14* (2006.01)
*F41A 3/78* (2006.01)

(52) U.S. Cl. ..... 42/73; 42/74; 42/75.01

(58) Field of Classification Search ..... 42/73, 42/74, 75.01; 89/198
See application file for complete search history.

(56) References Cited

U.S. PATENT DOCUMENTS

| | | | | |
|---|---|---|---|---|
| 2,790,262 | A | 4/1957 | Baker | |
| 3,710,496 | A * | 1/1973 | Packmayr et al. | 42/71.01 |
| 4,203,244 | A * | 5/1980 | Hickman | 42/73 |
| H000486 | H * | 7/1988 | Savioli | 42/73 |
| 4,896,446 | A * | 1/1990 | Gregory | 42/73 |
| 5,075,995 | A | 12/1991 | Kennel | |
| 5,235,764 | A * | 8/1993 | Perazzi | 42/73 |
| 5,392,553 | A | 2/1995 | Carey | |
| 5,410,833 | A | 5/1995 | Paterson | |
| 5,711,102 | A | 1/1998 | Plaster | |
| 5,819,460 | A | 10/1998 | Ockenfuss | |
| 5,970,642 | A * | 10/1999 | Martin | 42/73 |
| 6,807,763 | B1 * | 10/2004 | Leung | 42/71.01 |
| 6,839,998 | B1 * | 1/2005 | Armstrong | 42/71.01 |
| 6,874,267 | B2 * | 4/2005 | Fitzpatrick et al. | 42/72 |
| 6,901,691 | B1 * | 6/2005 | Little | 42/118 |
| 6,925,744 | B2 * | 8/2005 | Kincel | 42/71.01 |
| 7,104,001 | B1 * | 9/2006 | Digiovanna | 42/71.01 |
| 7,104,002 | B2 * | 9/2006 | Rotundo | 42/73 |
| 7,152,355 | B2 * | 12/2006 | Fitzpatrick et al. | 42/73 |
| 7,162,822 | B1 * | 1/2007 | Heayn et al. | 42/73 |
| 2003/0101631 | A1 | 6/2003 | Fitzpatrick | |
| 2004/0255505 | A1 | 12/2004 | Fitzpatrick | |
| 2005/0115140 | A1 | 6/2005 | Little | |
| 2006/0242880 | A1 * | 11/2006 | Griffin | 42/73 |
| 2007/0011932 | A1 * | 1/2007 | Oz | 42/94 |
| 2007/0056202 | A1 * | 3/2007 | Oz | 42/94 |
| 2007/0289190 | A1 * | 12/2007 | Oz | 42/73 |

FOREIGN PATENT DOCUMENTS

DE 19530793 A1 2/1997

* cited by examiner

*Primary Examiner*—Michael J. Carone
*Assistant Examiner*—Michael D David
(74) *Attorney, Agent, or Firm*—Robert L. Stone; Deborah Gador

(57) ABSTRACT

A telescoping stock for a firearm, the stock including a stock body having an upper mounting rail, a buffer tube holder for receiving a firearm buffer tube, the buffer tube holder having a complementary mounting rail, and locking means for selectably locking the buffer tube holder in any one of a plurality of positions relative to the stock body. Preferably, the telescoping stock also includes a telescoping cheek rest.

6 Claims, 7 Drawing Sheets

TELESCOPING STOCK

This application claims the benefit of Provisional Application No. 60/702,472, filed Jul. 26, 2005.

FIELD OF THE INVENTION

The present invention relates to telescoping stocks for firearms, in general and, in particular, to a telescoping replacement stock for M-16 type rifles and carbines.

BACKGROUND OF THE INVENTION

Removable and replacement stocks for rifles are well known. Stocks often include telescoping cheek rests and telescoping butt plates, for increased comfort of the shooter. However, the length of the stock can only be adjusted by providing different locations along the buffer tube holder for locking the stock. In order to readjust the length, the rifle must be removed from the user's shoulder, the buffer tube holder unlocked, the buffer tube adjusted inside the buffer tube holder, the buffer tube holder locked again, and only then the rifle is ready for use.

In general, in order to replace the stock of an M16-type carbine or commando rifle, the buffer tube may also have to be replaced, since there is no standard diameter for buffer tubes for short M16-type firearms.

There are also known extendable cheek rests. These can be extended manually, by lifting or pressing to the desired extension above the stock, or incrementally by rotating a knob.

SUMMARY OF THE INVENTION

The present invention provides a removable firearm stock which permits rapid and easy fine adjustment of the length of the stock. The firearm stock also includes an adjustable cheek rest, in which both the height above the stock can be adjusted and the location relative to a gun sight.

There is provided according to the present invention a telescoping stock for a firearm, the stock including a stock body having an upper mounting rail, a buffer tube holder for receiving a firearm buffer tube, the buffer tube holder having a complementary mounting rail; and locking means for selectably locking the buffer tube holder relative to the stock body.

There is also provided a removable firearm stock, the stock including a mounting unit having a mounting rail, and an adjustment unit including a cheek rest and a butt plate and having a complementary mounting rail, the complementary mounting rail on the adjustment unit being slideably mounted on the mounting rail of the mounting unit.

According to a preferred embodiment of the invention, the mounting unit includes an adapter, for coupling to buffer tubes of different diameters, in particular for short M16 carbines and commando rifles.

Further according to the invention, there is provided a firearm stock having a spring biased, telescoping cheek rest. The stock includes a release button, which permits the cheek rest to move up or down under the urging of the spring or of a shooter's cheek.

There is also provided a method for forming a telescoping stock for a firearm, the method including providing a stock body having an upper mounting rail, forming a buffer tube holder for receiving a firearm buffer tube, the buffer tube holder having a complementary mounting rail adapted for mounting on the stock body mounting rail, and providing a locking mechanism for selectably locking the buffer tube holder in one of a plurality of positions relative to the stock body.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1A:
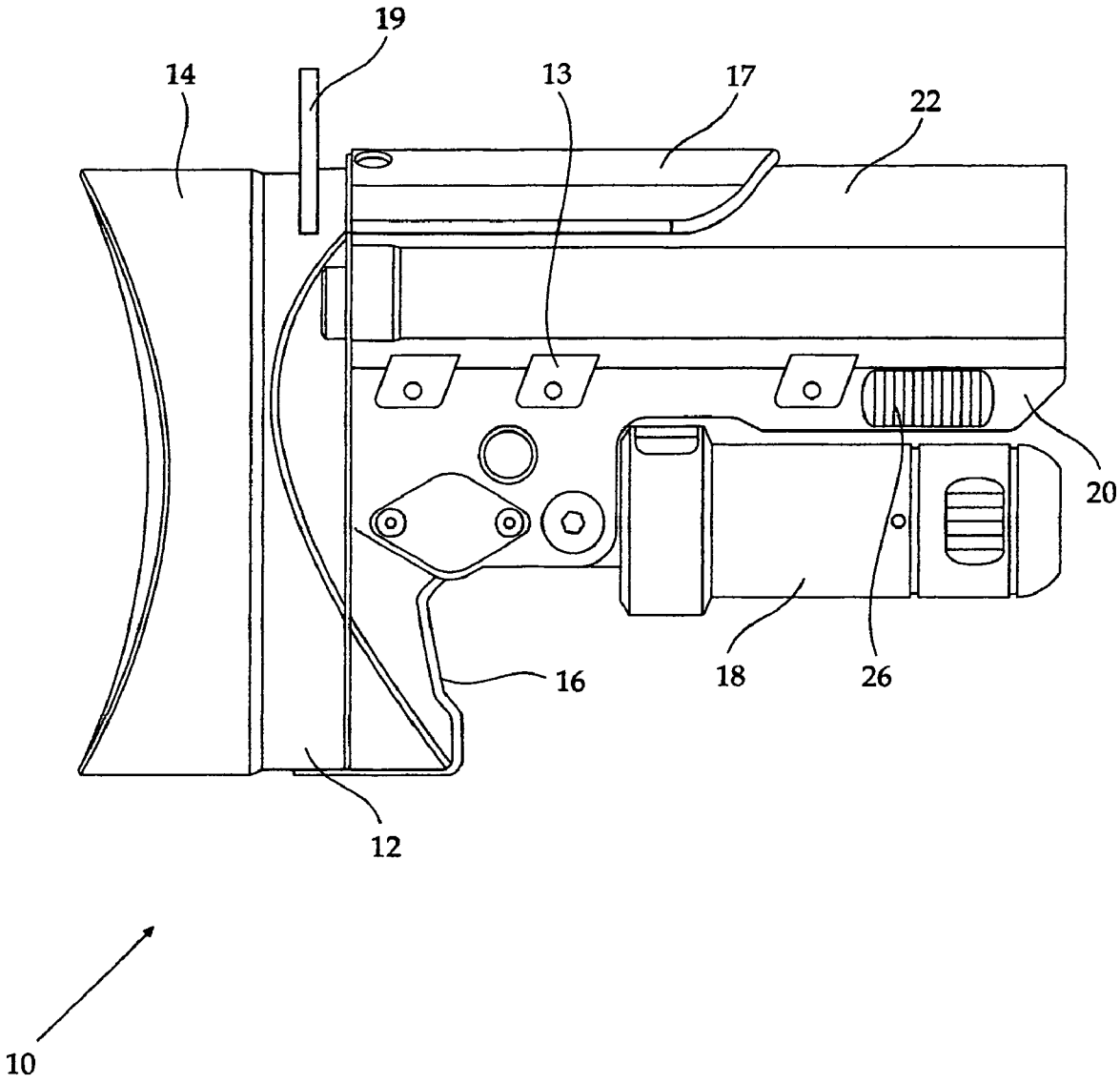
FIGS. 1*a* and 1*b* are schematic side view illustrations of a telescoping stock for a firearm constructed and operative in accordance with one embodiment of the present invention in respective closed and open orientations.

The present invention relates to a replacement stock for a firearm, particularly a short M16-type carbine or commando rifle, or any firearm modified so as to be able to receive such a stock, such as a Kalachnikov rifle. The stock includes a mechanism permitting extension of the stock to controllably lengthen the stock and, thus, the overall firearm, to fit the length of each shooter's arm. Thus, fine adjustment of the length of the stock is possible without having to adjust the location of the buffer tube in the buffer tube holder.

Referring now to FIGS. 1*a* to 1*d*, there are shown schematic side view illustrations of a telescoping stock 10 for a firearm constructed and operative in accordance with one embodiment of the present invention. Stock 10 includes a stock body 12 to which an adjustable butt plate 14 is slideably affixed. Stock body 12 includes an ergonomic hand rest 16 for grasping by the hand of a user to hold the stock against the user's body while firing. Side recesses 13 (shown in FIGS. 1*a* and 1*c*) may be provided for coupling and anchoring accessories to the firearm. A telescoping cheek rest 17, described in detail below, is also mounted on stock body 12. As seen most clearly in FIG. 1*d*, stock 10 further includes a slot 15 in which a sling holder 19 is pivotally mounted. Sling holder 19 can be pivoted to the right or left side of the stock, whichever is most convenient for the user. A foldable handle 18, which may be a telescoping third leg, is also mounted on stock 10. Handle 18 may be removed from the stock if not required, and preferably is provided with a quick release mechanism for coupling to the stock.

Figure 1B:
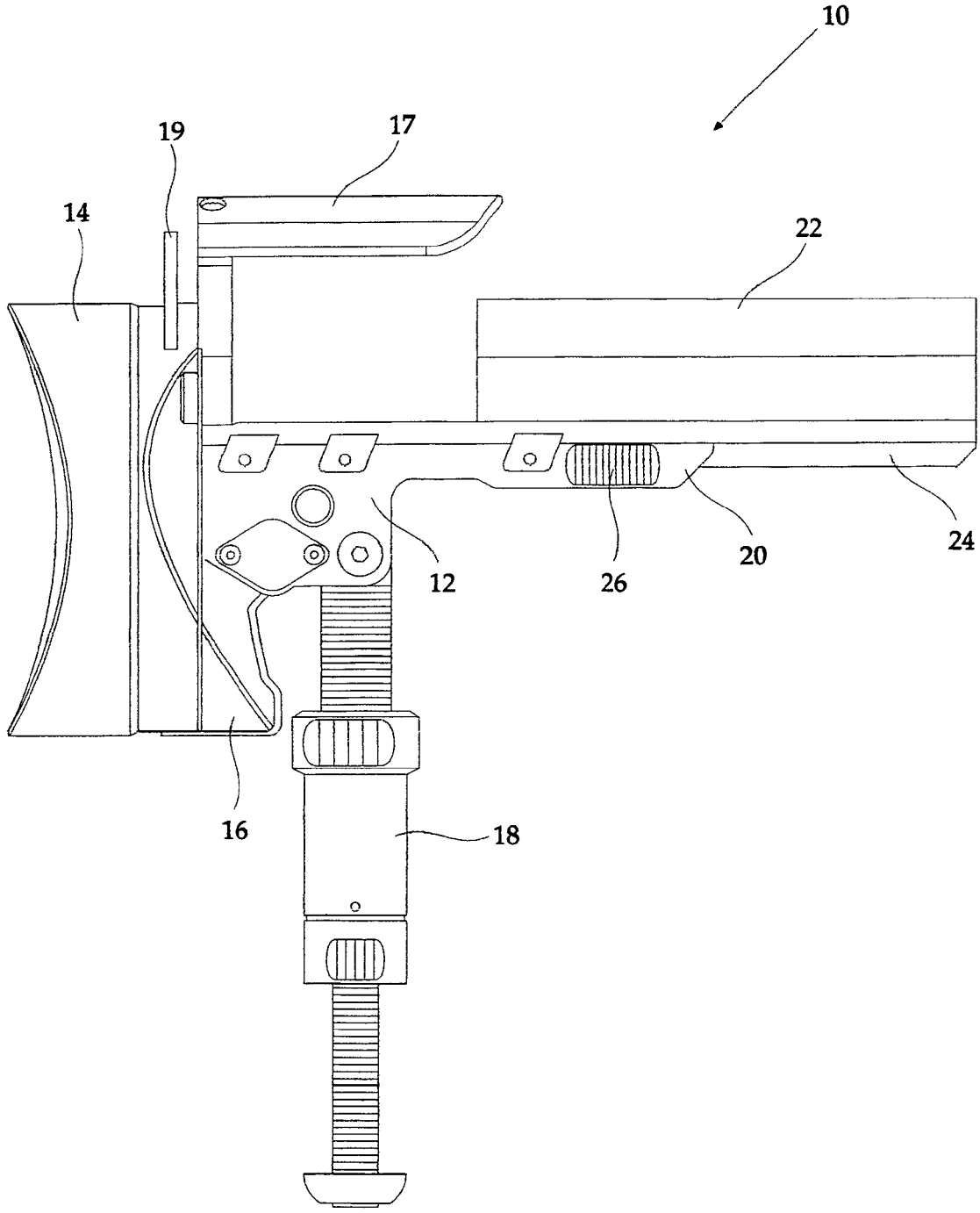
Figure 1C:
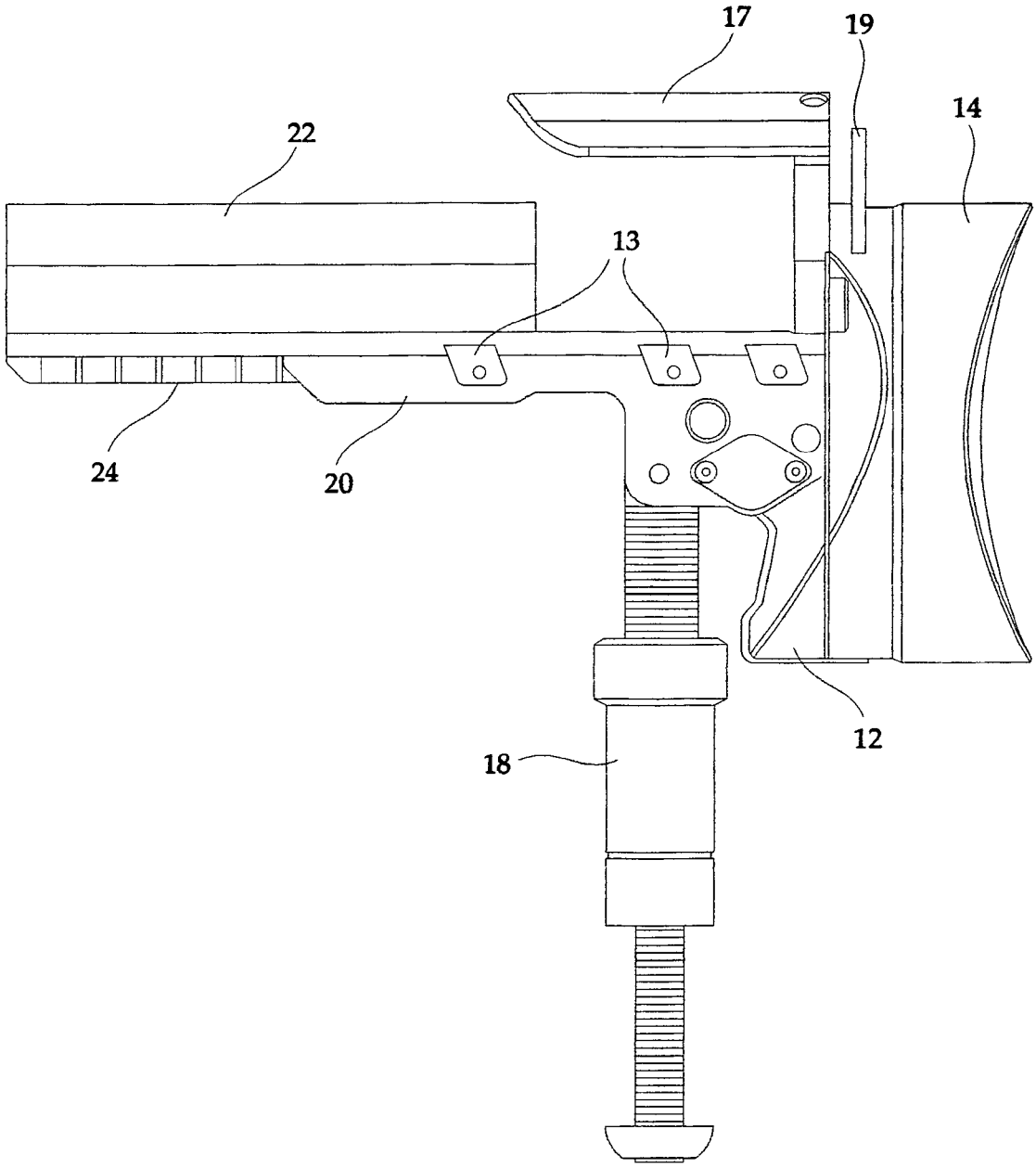
FIG. 1*c* is a schematic illustration of the stock of FIG. 1*b* taken from the other side.
Figure 1D:
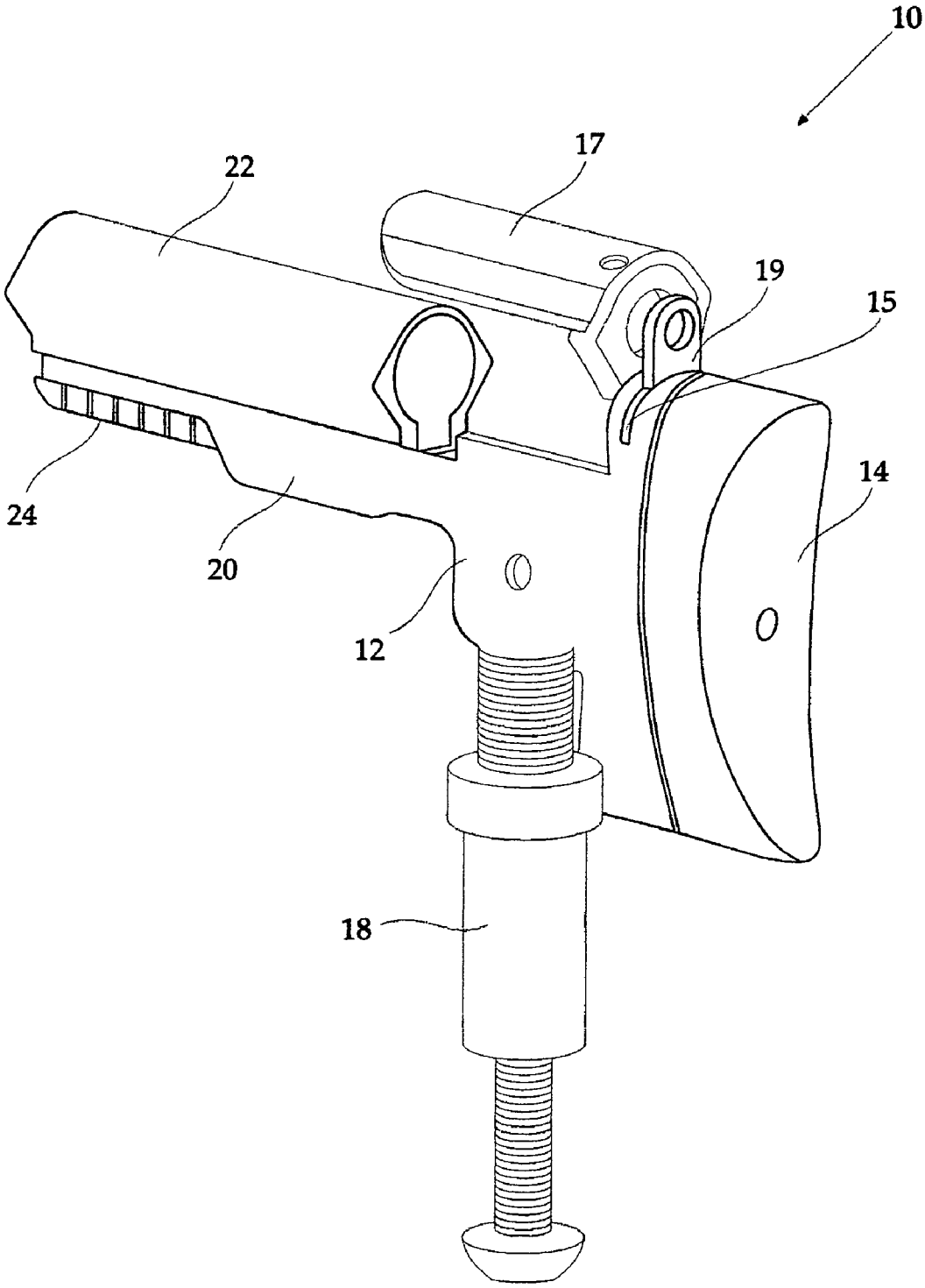
FIG. 1*d* is a rear perspective view of the stock of FIG. 1*b;*
Figure 2:
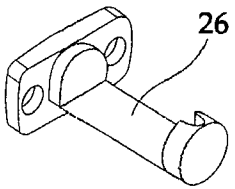
FIG. 2 is a perspective view of a rail lock element according to one embodiment of the invention.

Stock body 12 further includes an upper mounting rail 20, such as a dovetail rail, for example a Picatinny-type rail. A buffer tube holder 22 affixed to, or integrally formed with, a complementary rail 24 is slideably mountable on upper mounting rail 20 of stock body 12. Buffer tube holder 22 is adapted and configured to lockingly receive the buffer tube (not shown) of the firearm to which the stock 10 is to be attached. A rail locking element 26, for example that shown in FIG. 2, may be provided for locking the buffer tube holder 22 at a desired position along mounting rail 20. In this way, the length of the firearm can be adjusted to fit the length of the arm of the user, by releasing rail locking element 26 and sliding the buffer tube holder and the body of the firearm towards or away from stock 10 until a comfortable length is reached, when rail locking element 26 is engaged and locks the buffer tube holder relative to the stock body. For example, FIG. 1*a* shows the stock at its shortest length, while FIG. 1*b* shows the stock at an extended length. It will be appreciated that the number and size of the teeth in the mounting rail determines the precision with which the length of the stock can be adjusted.

It will be appreciated by those skilled in the art that the fact that the buffer tube holder is a separate component from the stock body permits the manufacture and replacement of the buffer tube holder to suit the particular firearm with which the stock is to be used. Thus, the buffer tube holder appropriate for the desired firearm can be inserted into the stock body. In the illustrated embodiment, buffer tube holder 22 is designed to receive the buffer tube of an M16 carbine or commando rifle.

Alternatively, it is a particular feature of one embodiment of the invention that the buffer tube holder 22 of stock 10 can be used with substantially any firearm having a buffer tube of similar shape. This is made possible by the use of an adapter 40, as shown in FIG. 3*a* and in FIG. 4*b* (a sectional view of a stock according to the invention mounted on a buffer tube 50, seen in side view in FIG. 4*a*). Adapter 40 is a flat, elongate strip of metal with two apertures 42, one at each end. Preferably, apertures 42 are conical apertures for receiving set screws. Adapter 40 is arranged to seat in the recess (shown in FIG. 4*b*) existing in the buffer tube for affixing the buffer tube to a stock. Set screws, or other affixing means, may be inserted through openings in the bottom of stock body 12 and through holes 42 in adapter 40, to press buffer tube 50 against the internal walls of buffer tube holder 22. In this way, it is sufficient to provide an adapter suited to the recess of the particular firearm buffer tube in order to permit the usage of the replacement stock of the invention on that firearm.

Figure 3B:
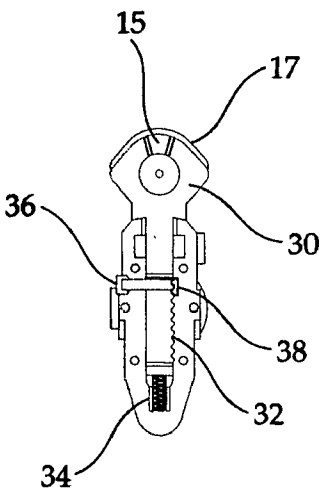
FIG. 3*b* is a sectional view of the stock of FIG. 3*a* taken through the cheek rest.
Figure 3A:
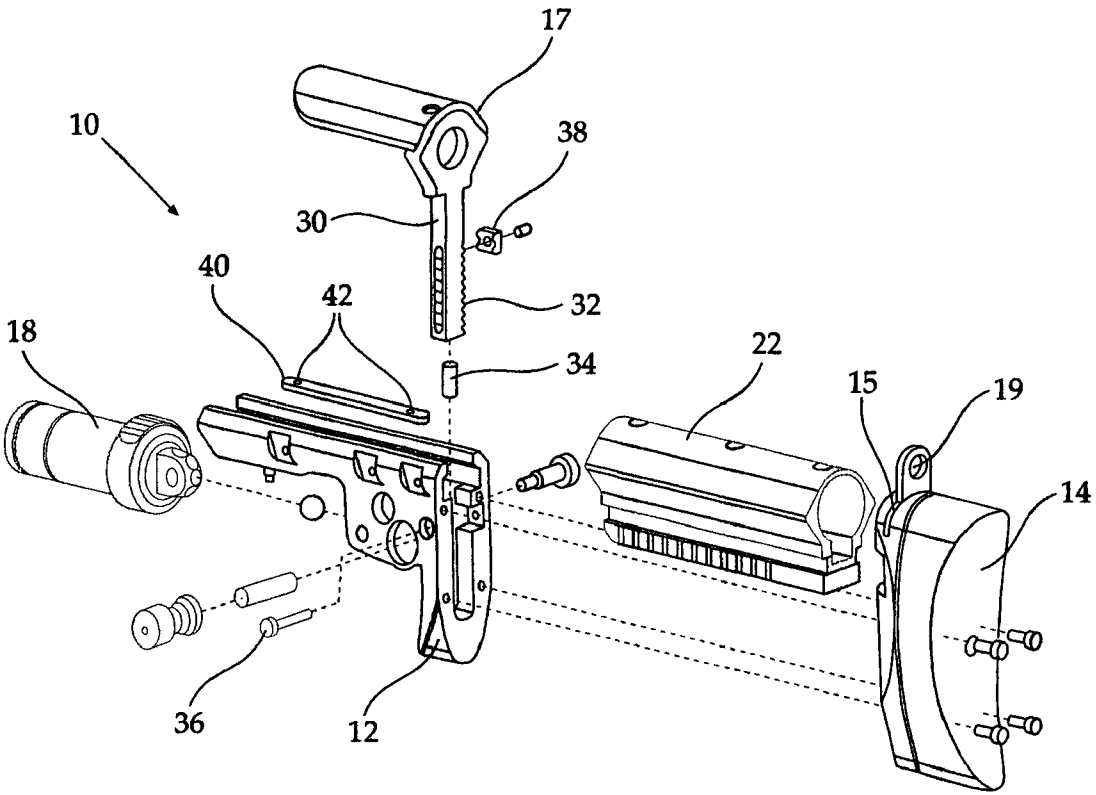
FIG. 3*a* is an exploded view of the stock of FIG. 1*a;*
Figure 4A:
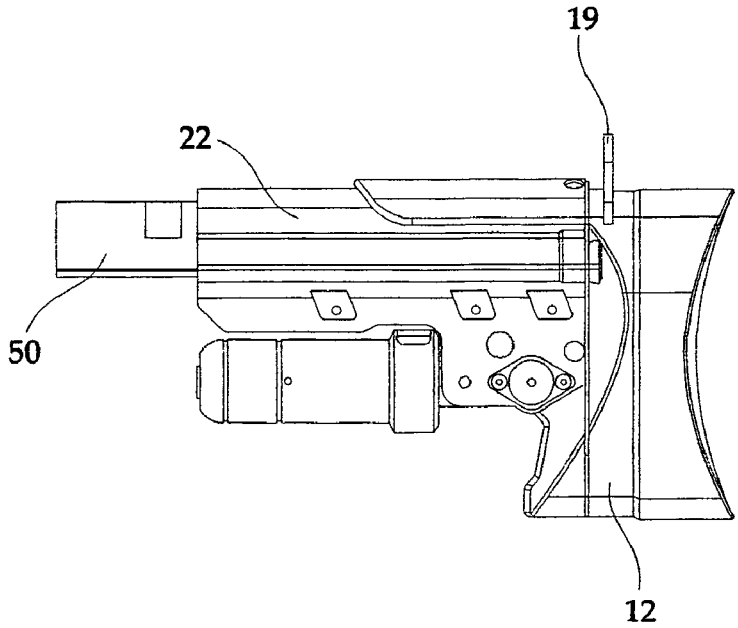
FIG. 4*a* is a side view of the stock of FIG. 1*a* mounted on the buffer tube of a firearm.
Figure 4B:
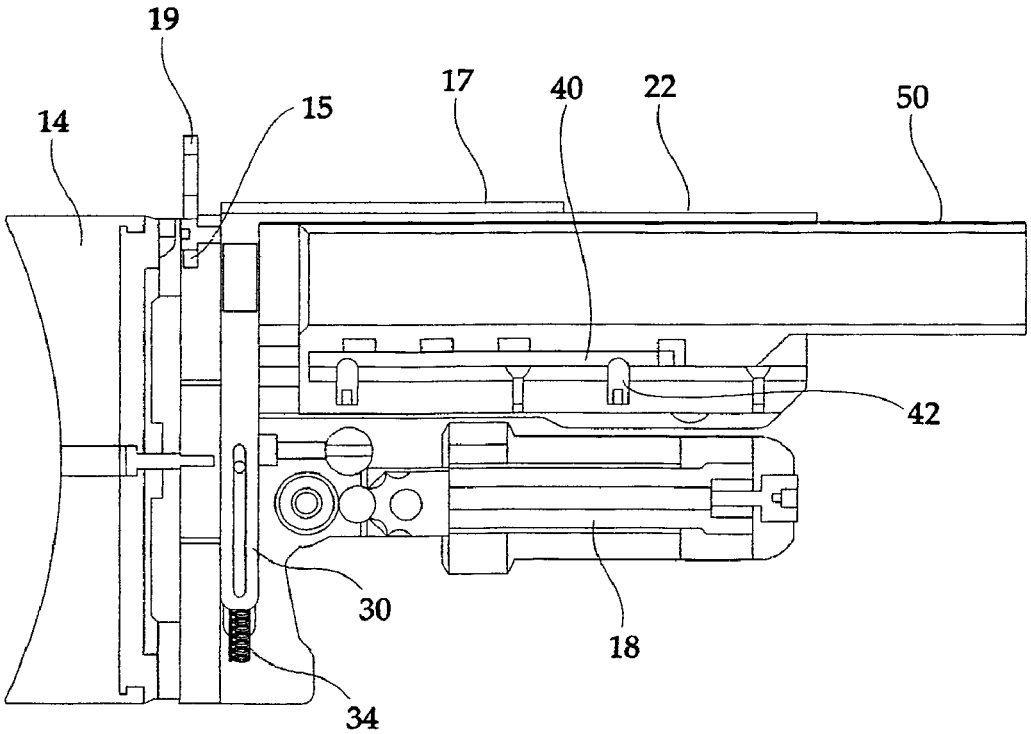
FIG. 4*b* is a side sectional view of the stock of FIG. 1*a*.

FIG. 3*a* is an exploded view and FIG. 3*b* is a sectional view of stock 10. In these views, the structure of cheek rest 17, according to one embodiment of the invention, can best be seen. Cheek rest 17 is mounted on a stem 30. Stem 30 has teeth 32 along a lower portion thereof. Stem 30 is spring-loaded in stock body 12 against the action of a spring 34. A spring-biased release button 36 having a locking element 38 is coupled to stem 30 through stock body 12. Pressing release button 36 causes cheek rest 17 to jump upwards out of stock body under the urging of spring 34. The desired height can be attained by pressing down with the user's cheek until the right height is reached. When release button 36 is let go, locking element 38 engages teeth 32 of stem 30, thereby locking the cheek rest at the desired height above the firearm. It will be appreciated that, alternatively, cheek rest 17 may be mounted for telescoping movement in the stock in any other fashion.

Figure 5B:
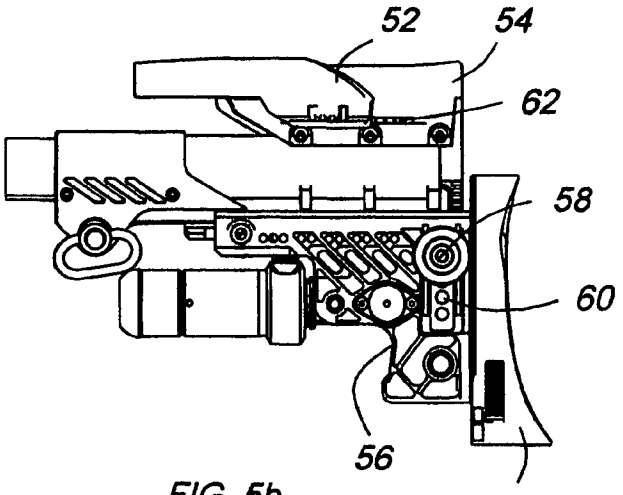
FIGS. 5*a*, 5*b*, 5*c* and 5*d* are side views of stocks according to alternative embodiments of the invention with cheek rests in adjusted orientations.
Figure 5D:
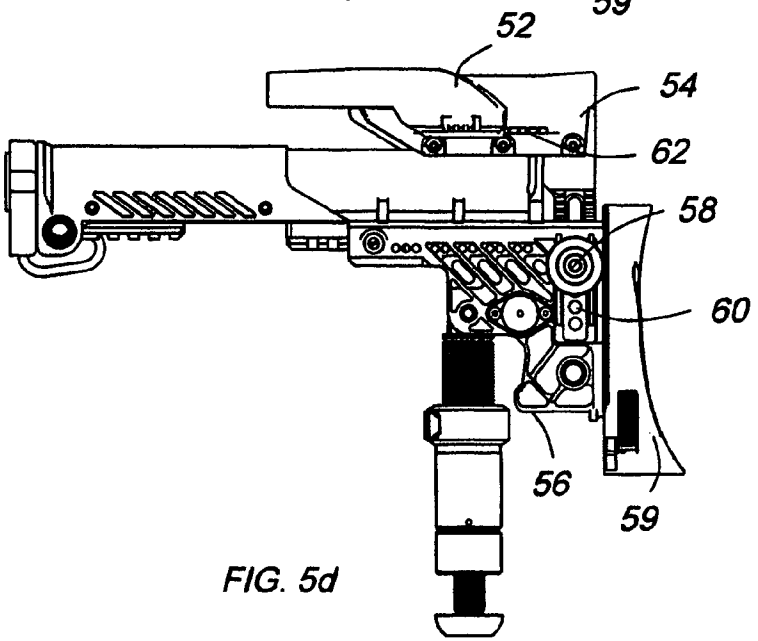
Figure 5A:
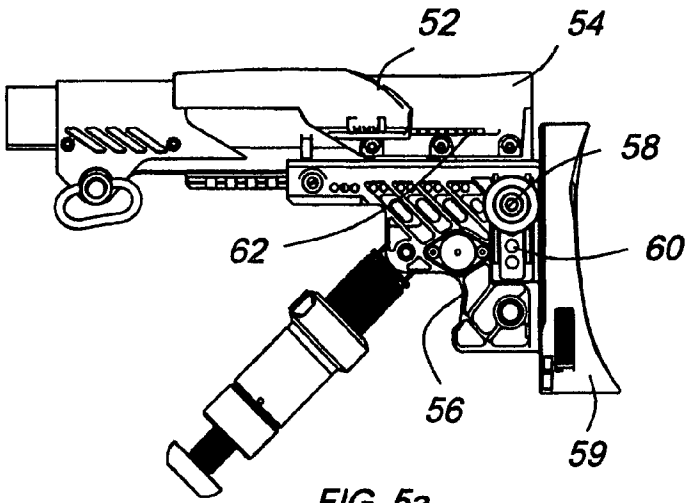
Figure 5C:
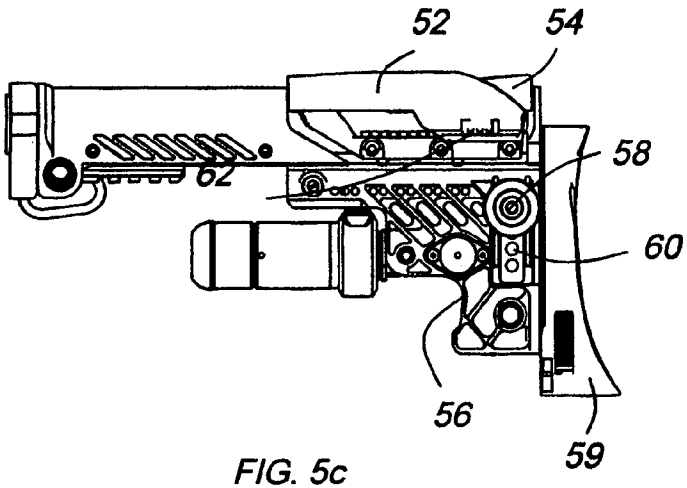

According to one embodiment of the invention, the cheek rest can move relative to the stock both axially (height above the buffer tube holder) and longitudinally (parallel to the buffer tube holder). This permits a shooter to adjust the location of the cheek rest relative to the front sight. Two examples of such a stock are shown in FIGS. 5*a* and 5*c*, for an M16 and SR25 respectively. In these embodiments, a cheek rest 52 is mounted on a telescoping frame 54 which, in turn, is mounted on stock body 56. Frame 54 with cheek rest 52 is movable up and down relative to stock body 56. Frame 54 is locked in place as by means of a screw knob 58, which can be inserted through any of a plurality of locking apertures 60 in frame 54 and into a locking aperture (not shown) on the stock. In addition, cheek rest 52 is movable forwards and back relative to frame 54, to provide maximum comfort and convenience to a shooter. In the illustrated embodiment, the motion is provided by means of a pair of parallel tracks 62 in frame 54 into which feet or slider elements (not shown) on cheek rest 52 are slidably inserted. Preferably, locking means are provided to lock the cheek rest in a desired orientation. Alternatively, any other method of providing this sliding motion can be utilized.

FIG. 5*c* shows the cheek rest 52 and frame 54 in the completely collapsed orientation, closest to the stock body 56 and butt plate 59. The cheek rest 52 can move longitudinally relative to frame 54 along tracks 62, as shown in FIGS. 5*a*, 5*b* and 5*d*. FIG. 5*a* illustrates the cheek rest frame in its lowered orientation, with the cheek rest 52 moved forward relative to butt plate 59. FIGS. 5*b* and 5*d* illustrate the cheek rest 52 and cheek rest frame 54 in their completely extended orientations, farthest from the stock body 56 and from butt plate 59, for the M16 and SR25, respectively.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follo

The invention claimed is:

1. A telescoping stock for a firearm, the stock comprising:

a stock body having an upper mounting rail;

a buffer tube holder for receiving a firearm buffer tube, said buffer tube holder having a complementary mounting rail adapted for mounting on said stock body mounting rail;

locking means for selectably locking the buffer tube holder in one of a plurality of positions relative to the stock body; and an adapter in said buffer tube holder for coupling buffer tubes of different diameters to said buffer tube holder by urging the buffer tube against inner walls of the buffer tube holder.

2. The telescoping stock according to claim 1, further comprising:

a cheek rest frame coupled to the stock body for raising and lowering said cheek rest relative to the stock body;

a cheek rest mounted on said cheek rest frame; and means for moving said cheek rest longitudinally relative to said cheek rest frame.

3. The telescoping stock according to claim 2, wherein the cheek rest comprises:

a spring-biased stem mounted in the stock; and releasable locking means for coupling said stem to the stock at one of several selected positions relative to the stock.

4. The telescoping stock of claim 3, wherein said releasable locking means includes teeth extending from said stem and a releasable tooth engagement element mounted in the stock.

5. A method for forming a telescoping stock for a firearm, the method comprising:

providing a stock body having an upper mounting rail;

forming a buffer tube holder for receiving a firearm buffer tube, said buffer tube holder having a complementary mounting rail adapted for mounting on said stock body mounting rail; and providing locking means for selectably locking said buffer tube holder in one of a plurality of positions relative to said stock body;

providing an adapter, for coupling buffer tubes of different diameters to said buffer tube holder.

6. The method according to claim 5, further comprising:

coupling a cheek rest frame to the stock body for raising and lowering said cheek rest relative to the stock body;

mounting a cheek rest mounted on said cheek rest frame; and providing means for moving said cheek rest longitudinally relative to said cheek rest frame.

* * * * *